US005960785A

United States Patent [19]

Byrne et al.

[11] Patent Number: 5,960,785

[45] Date of Patent: Oct. 5, 1999

[54] COOKING RANGE OVEN HAVING INSULATED OVEN DOOR WITH VIEWING SYSTEM

[75] Inventors: Robert M. Byrne, Lima, Ohio; Scott A. Calvert, Louisville, Ky.; Craig A. Blazakis, Dublin; Bret E. Kline, Columbus, both of Ohio

[73] Assignee: American Trim, LLC, Lima, Ohio

[21] Appl. No.: 08/864,485

[22] Filed: May 28, 1997

[51] Int. Cl.[6] ..... F23M 7/00

[52] U.S. Cl. ..... 126/200; 126/190; 99/341; 220/663

[58] Field of Search ..... 126/190, 194, 126/198, 200, 213; 99/341; 362/92; 220/377, 662, 663; 52/308, 788.1, 204.593

[56] References Cited

U.S. PATENT DOCUMENTS

| | | | |
|---|---|---|---|
| 1,716,800 | 6/1929 | Siegert | 362/92 |
| 1,961,943 | 6/1934 | Powell | 126/200 |
| 2,281,608 | 5/1942 | Vincent | 126/200 |
| 2,428,987 | 10/1947 | Pellegrin | 126/200 |
| 2,604,886 | 7/1952 | King | 126/200 |
| 2,687,125 | 8/1954 | Sherman | 126/200 |
| 2,733,706 | 2/1956 | Feder | 126/200 |
| 3,128,363 | 4/1964 | Rose, Jr. et al. | 219/35 |
| 3,151,612 | 10/1964 | Keeling, Sr. et al. | 126/200 |
| 3,623,472 | 11/1971 | Mazza | 126/273 |
| 3,898,977 | 8/1975 | Draper | 126/200 |
| 4,041,930 | 8/1977 | Katona | 126/200 |
| 4,084,571 | 4/1978 | McFarland | 126/200 |
| 4,207,863 | 6/1980 | Drouin | 126/200 |
| 4,287,873 | 9/1981 | Goins et al. | 126/94 |
| 4,434,784 | 3/1984 | Van Patten | 126/200 |
| 4,638,788 | 1/1987 | Lancelot | 126/198 |
| 4,729,364 | 3/1988 | Dailey | 126/200 |
| 4,880,955 | 11/1989 | Nitzinger et al. | 362/92 |
| 4,898,147 | 2/1990 | Doni et al. | 126/200 |
| 5,022,380 | 6/1991 | Faurel et al. | 126/190 |
| 5,193,520 | 3/1993 | Gostelow et al. | 126/21 A |
| 5,235,962 | 8/1993 | Doty et al. | 126/21 A |
| 5,375,587 | 12/1994 | Ward et al. | 126/190 |
| 5,406,057 | 4/1995 | Komatsu et al. | 219/740 |
| 5,441,036 | 8/1995 | Mikalauskas, II et al. | 126/200 |
| 5,447,145 | 9/1995 | Cappello et al. | 126/20 |
| 5,546,927 | 8/1996 | Lancelot | 126/194 |
| 5,584,284 | 12/1996 | Corliss, II et al. | 126/190 |
| 5,588,421 | 12/1996 | Busch et al. | 126/200 |
| 5,712,468 | 1/1998 | Ace | 362/92 |
| 5,735,261 | 4/1998 | Kieslinger | 126/200 |

FOREIGN PATENT DOCUMENTS

| | | | |
|---|---|---|---|
| 0 440 297 A2 | 8/1991 | European Pat. Off. | 126/200 |
| 1 901 616 | 10/1970 | Germany . | |

OTHER PUBLICATIONS

Brochure entitled "The world's leading high performance Thermal Insultation," dated Jan. 1996, pp. 1–20.

*Primary Examiner*—Ira S. Lazarus
*Assistant Examiner*—Josiah C. Cocks
*Attorney, Agent, or Firm*—Rankin, Hill, Porter & Clark LLP

[57] ABSTRACT

A door for the oven of a cooking range includes an inner panel that closes the oven and an outer panel spaced from the inner panel. The inner and outer panels are connected adjacent their upper edges by an upper panel. The inner panel includes a first window in the form of a wide-angle lens. The upper panel includes a second window. Light-transmissive devices including a prism and a mirror are disposed between the inner and outer panels so as to direct light received through the lens upwardly and outwardly through the second window. The interior of the oven is illuminated by low-voltage halogen lights carried by the inner panel. The door is insulated by disposing a microporous metal oxide thermal insulation material against the oven side of the inner panel. The insulation is held in place by a plate. The door includes an oven-contacting gasket that extends beyond the boundaries of the plate to provide a thermal barrier when the door off the oven is closed.

21 Claims, 7 Drawing Sheets

COOKING RANGE OVEN HAVING INSULATED OVEN DOOR WITH VIEWING SYSTEM

BACKGROUND OF THE INVENTION

1. Field of the Invention

The invention relates to ovens for cooking ranges and, more particularly, to insulated oven doors having the capability to view the interior of the oven without opening the door. The oven door of the present invention is especially well-suited for use in connection with self-cleaning (pyrolitic) type cooking ranges.

2. Description of the Prior Art

When the oven door of a cooking range is closed, it is desirable to be able to observe the interior of the oven without opening the oven door so as to prevent the loss of accumulated heat from the oven. The prior art recognizes two techniques for observing the interior of the oven without opening the oven door; observation windows provided in the oven doors, and observation windows provided in the oven walls, usually a top wall. Examples of the former approach are legion, and include U.S. Pat. No. 2,428,987, U.S. Pat. No. 2,604,886, and U.S. Pat. No. 3,898,977. Examples of the latter approach also are numerous, and include U.S. Pat. No. 2,687,125, U.S. Pat. No. 2,733,706, U.S. Pat. No. 3,128,363, U.S. Pat. No. 3,151,612, and U.S. Pat. No. 3,623,472.

A problem with oven doors having transparent windows is that it is necessary to bend over in order to be able to observe the interior of the oven. Also, there are various difficulties associated with insulating the oven door adequately and keeping the window clean on its interior surface.

A problem associated with cooking ovens having windowed walls is that such viewing systems can be quite expensive and can require extensive structural modifications of the oven. Further, such devices are believed to provide less than desirable observation of the interior of the oven. In part, the difficulty associated with viewing the interior of the oven, whether with a windowed oven door or a windowed oven wall, is that the interior light that illuminates the oven usually is underpowered and poorly placed.

Desirably, an oven door for a cooking range would be available that would provide a highly effective technique for viewing the interior of the oven. Any such oven door preferably would be well insulated, and it would include a lighting system that would effectively illuminate the interior of the oven.

In the description and claims that follow, reference will be made to various components of the invention and their orientation through the use of such words as "upper," "horizontally," "vertically" and so forth. The use of such words is in conjunction with a door-closed position as will occur during normal use of the invention. It is to be understood that the use of such terms of orientation is solely for purposes of convenience. The various components of the invention can be disposed in different orientations and can be described by different words of orientation without departing from the teachings of the present invention.

SUMMARY OF THE INVENTION

The present invention provides a new and improved oven for a cooking range having a door that is well insulated and which provides the capability to view the interior of the oven without opening the door. Furthermore, the oven door of the present invention provides the ability to build a thinner door cross section which allows the appliance to remain flush to adjoining kitchen cabinets while maintaining a cool door surface during operation. Also, if desired, the oven door of the present invention allows one to build a larger oven cavity than would be permitted using a conventional door. The oven door of the present invention is especially well-suited for use in connection with self-cleaning (pyrolitic) type cooking ranges that experience quite high temperatures during the cleaning cycle.

The oven has a cavity within which food may be cooked and a marginal edge defining the boundary of the cavity. The door includes an inner panel that in use closes the oven cavity and an outer panel spaced from the inner panel. An upper panel connects the inner and outer panels adjacent their upper edges.

An opening is formed in the inner panel and a first window, preferably in the form of a wide-angle lens, is mounted in the opening in the inner panel. A first light transmissive device is disposed between the inner and outer panels. The first light transmissive device directs light received through the first window toward the upper panel.

An opening is formed in the upper panel within which a second window is mounted. Accordingly, light can pass through the first window, through the first light transmissive device, between the inner and outer panels, and outwardly through the second window. Because the second window is adjacent the upper edges of the inner and outer panels, the user can conveniently view the interior of the oven with minimal bending.

In the preferred embodiment, the first light transmissive device is a right-angled prism disposed adjacent the first window. A second light transmissive device is disposed between the inner and outer panels adjacent the second window. The second light transmissive device, in the preferred embodiment, includes a mirror and a second, right-angled prism.

The invention includes alternative embodiments. In one alternative embodiment, the first light transmissive device is a convex lens that expands the light received from the first window so as to project it directly onto an enlarged second window without the need for a second light transmissive device. In another alternative embodiment, the first light transmissive device is a concave lens. The second light transmissive device is a light pipe that receives light from the concave lens and directs it through a wide angle lens onto an enlarged second window.

In order to adequately illuminate the interior of the oven, a light is secured to the inner panel and is positioned so as to illuminate the interior of the oven when the door is closed. Preferably, two such lights are provided, one on either side of the first window. Desirably, the lights are low-voltage halogen lights to which electrical current is supplied by contacts carried by the inner panel and the marginal edge of the oven. The contacts engage each other when the door is closed, and are disengaged from each other when the door is opened. Preferably, one of the contact is spring loaded to allow engagement when the door is partially open such as during broiling.

The invention also includes the new and improved technique for insulating the door. A plate is disposed between the inner panel and the interior of the oven. A layer of insulation is disposed between the inner panel and the plate. The plate is connected to the inner panel such as the insulation is disposed between the plate and the inner panel. In one embodiment, the edges of the plate are spaced inwardly from the edges of the inner panel and a thermal gasket is disposed about the periphery of the layer of insulation, the gasket extending beyond the edges of the plate. In another embodiment there is provided an inner plate and the insulation is disposed between the plate and the inner plate and a fiberglass gasket is compressed between the inner plate and the inner panel along the periphery of the inner plate. Accordingly, in either embodiment when the door is closed, the gasket engages the marginal edge of the oven and is compressed against the marginal edge of the oven by the inner panel. In the preferred embodiment, the insulation comprises a microporous metal oxide thermal insulation having a thermal conductivity of less than 0.029 w/(m.K) at 0° C.

As will be apparent, the invention provides an effective, relatively inexpensive technique for viewing the interior of the oven without opening the door and for effectively insulating the oven door. The foregoing, and other features and advantages of the invention, will be apparent from the description and claims that follow, taken in conjunction with the accompanying drawings.

DESCRIPTION OF THE PREFERRED EMBODIMENT

Figure 1:
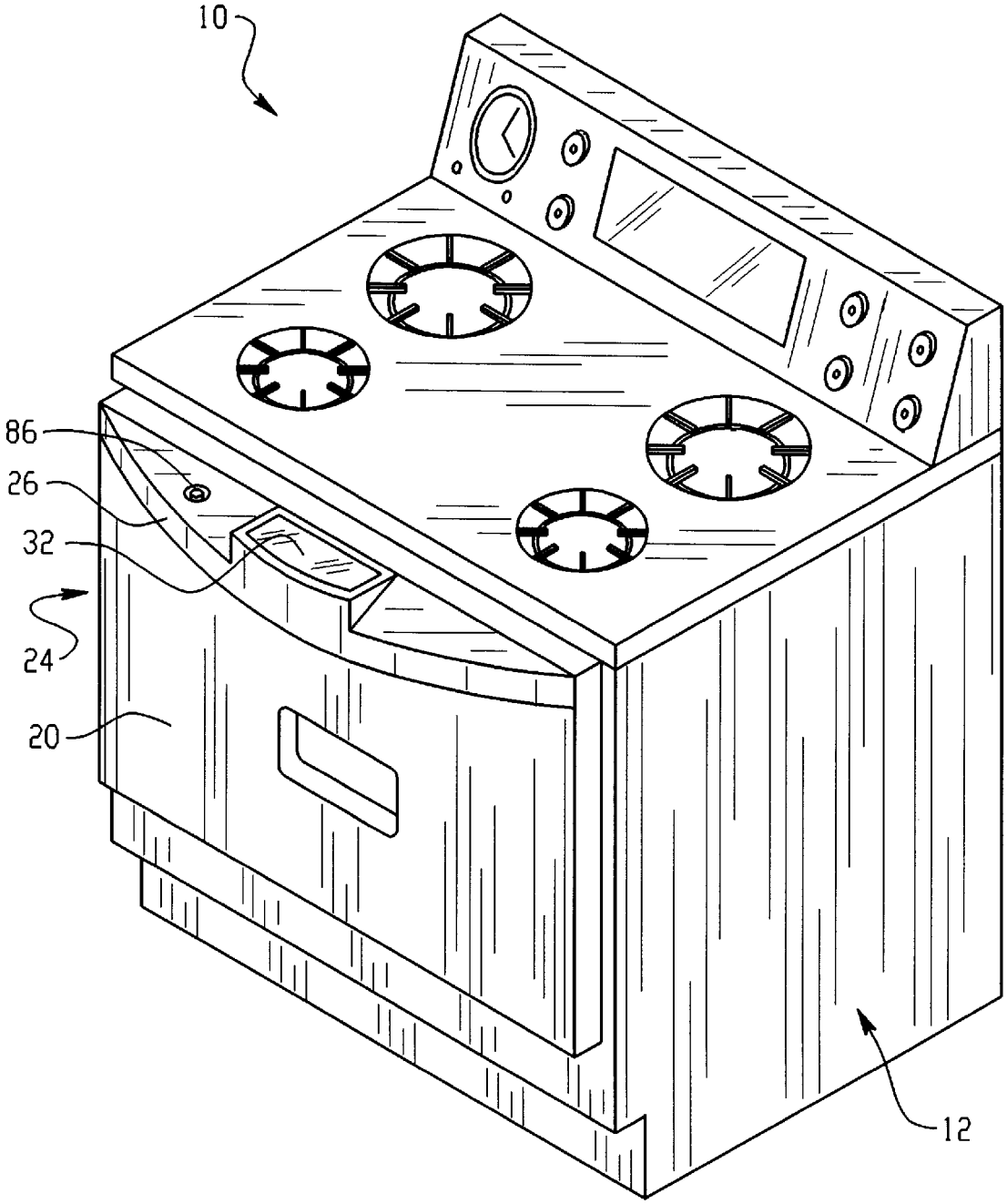
FIG. 1 is a perspective view of a cooking range having an oven according to the invention.
Figure 3:
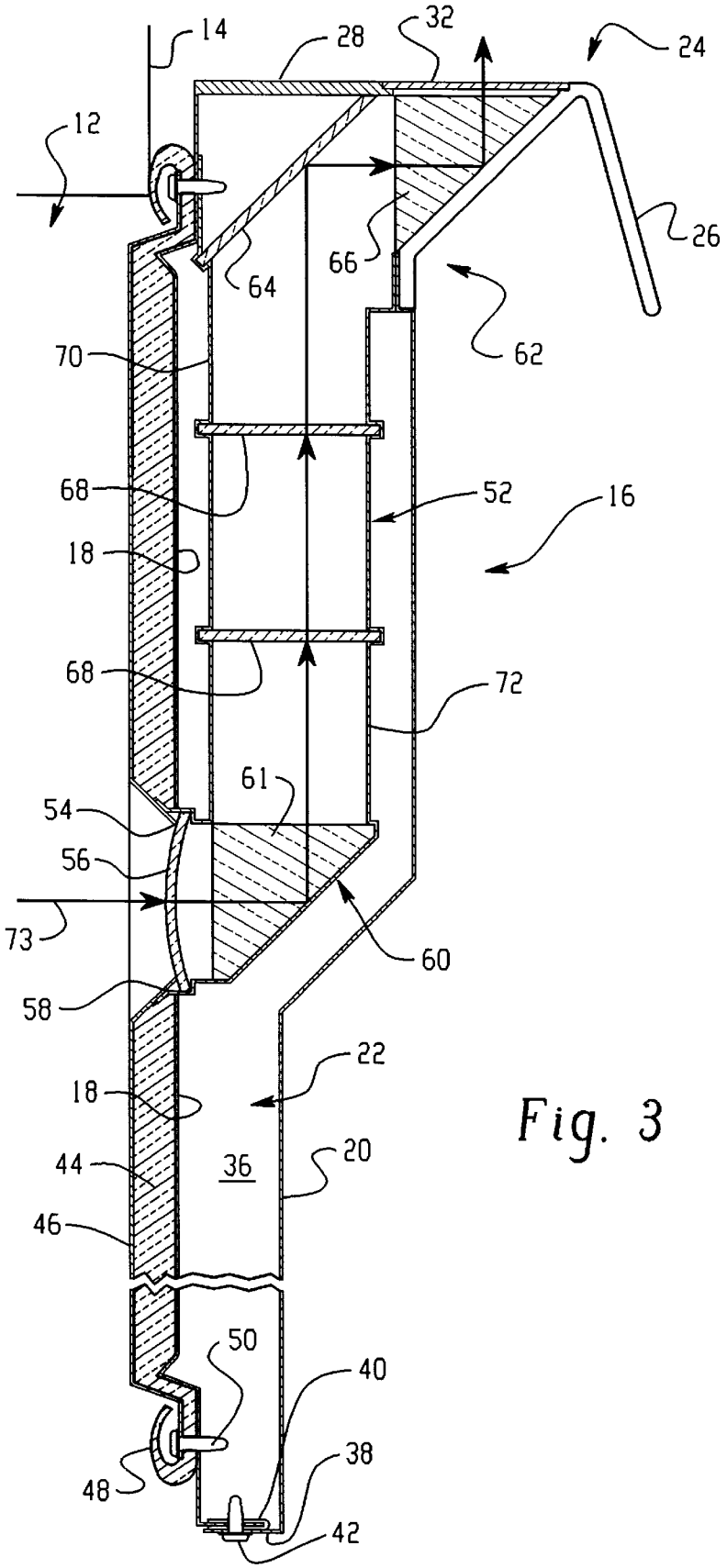
FIG. 3 is a cross-sectional view of the door FIG. 1 taken along a plane through the center of the viewing system.

Referring to FIG. 1, a range according to the invention is indicated generally by the reference numeral 10. The range 10 has an oven 12 that defines a cavity within which food may be cooked. As best shown in FIGS. 3 and 6B, the oven 12 includes a marginal edge 14 that defines the external boundary of the oven 12. The range 12 includes a door 16 that closes the oven 12 and provides access thereto when needed.

Figure 2:
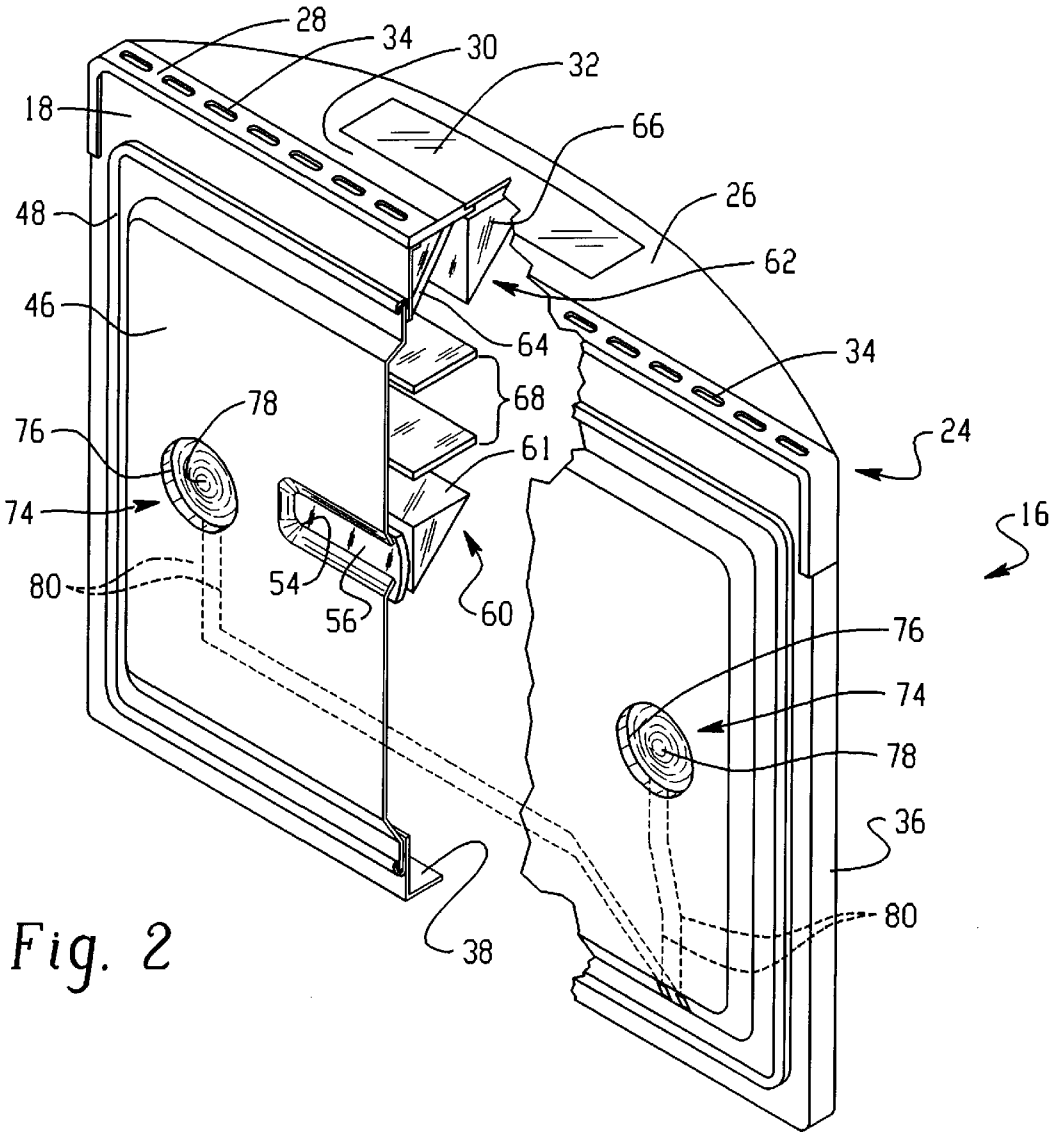
FIG. 2 is a perspective view of an oven door according to the invention, with portions of the door broken away and removed for clarity of illustration, showing a viewing system whereby a user can view the interior of the oven without opening the oven door.

Referring now to FIGS. 2 and 3, the door 16 includes an inner panel 18 of porcelainized steel and an outer panel 20 of high gloss or painted steel. Preferably, outer panel 20 comprises a high tensile aluminum alloy that is available under the trade designation SMP2 from American Trim, L.L.C. of Lima, Ohio. The panels 18, 20 are parallel to each other but are spaced apart so as to form a chamber 22. The upper end of the chamber 22 is closed by a top cap 24. As can be seen in FIG. 3, the top cap 24 is secured to the upper ends of the panels 18, 20.

The top cap 24 includes a handle 26 and a generally horizontal upper panel 28. The upper panel 28 has a center portion 30 within which a window 32 is disposed for a purpose to be explained subsequently. The upper panel 28 includes a plurality of vents 34. The door 16 also includes sidewalls 36 and a bottom wall 38. A U-shaped, high temperature insulator 40 spaces the folded edges of the inner and outer panels 18, 20 where they intersect to form the sidewalls 32 and the bottom wall 38. A plurality of pins or screws 42 extend through the sidewalls 36, the bottom wall 38 and the insulator 40 in order to secure the inner and outer panels 18, 20 to each other.

The door 16 is insulated in order to retain heat effectively within the oven cavity 12. The insulation is provided by a sheet 44 of metal oxide thermal insulation approximately 0.75 inch thick. The sheet 44 is held in place against the inner panel 16 by means of a retainer plate 46 that is made of porcelainized steel. The sheet 44 includes a gasket 48 that is attached to the periphery of the sheet 44. The gasket extends beyond the edges of the plate 46. The gasket 48 is bent back upon itself in order to provide a flexible surface that may be compressed against the marginal boundary 14 by the inner panel 18. The sheet 44 and the plate 46 are held in place against the inner panel 18 by means of pins or screws 50. As can be seen in FIG. 3, the heads of the pins or screws 50 are covered by the gasket 48. Preferably, the sheet of insulation 44 is a microporous metal oxide thermal insulation having a thermal conductivity of less than 0.029 w/(m.K) at 0° C. An example of such an insulation is a product sold under the trade name MICROTHERM by Microporous Insulation Limited of Merseyside, England. The microporous insulation is extremely insulative and thus it allows one to build a door of thinner cross section as compared to conventional doors.

The oven 12 includes a viewing system 52 that is incorporated into the door 16. An opening 54 is formed in the inner panel 18 and the retainer plate 46. A window 56 in the form of a wide-angle lens is disposed in the opening 54. The plate 46 includes a beveled portion 58 that defines a portion of the opening 54. The beveled portion 58 holds the lens 56 in place.

A first light transmissive device 60 in the form of a right-angled prism 61 is disposed within the chamber 22 adjacent the lens 56. A second light transmissive device 62 is disposed within the chamber 22 adjacent the window 32. The second light transmissive device 62 includes a mirror 64 and a second right-angled prism 66. A pair of spaced glass heat shields 68 are disposed within the chamber 22 intermediate the first and second light transmissive devices 60, 62. Heat shields 68 preferably comprise tempered glass having a heat reflective coating. A pair of spaced brackets 70, 72 hold the lens 54, the first and second light transmissive devices 60, 62, and the glass heat shields 68 securely in place within the chamber 22.

As shown in FIG. 3, the path of light through the viewing system 52 is indicated by the reference numeral 73. The smaller faces of the prism 61 are oriented perpendicular and parallel, respectively, to the path 73. The mirror 64 is inclined at an angle of 45 degrees to the path 73, and the second prism 66, like the prism 61, has smaller faces that are disposed perpendicular and parallel, respectively, to the path 73. As can be seen in FIG. 3, light passes generally horizontally through the lens 56, is directed vertically by the prism 61, is deflected horizontally by the mirror 64, and then is directed vertically through the window 32 by the prism 66. The heat shields 68 are disposed at right angles to the path 73 in order to minimize any distortion or reflection.

Referring now to FIG. 2, the oven 12 includes a pair of lights 74 that are included as part of the door 16. The lights 74 include an opening 76 that is formed in the plate 46 and the inner panel 18 on either side of the lens 56 at approximately the same vertical elevation as the lens 56. The openings 76 are formed in a manner similar to the opening 54. A low voltage halogen lamp 78 is disposed in each opening 76. Electrical leads 80 supply current to the lamps 78.

Figure 6A:
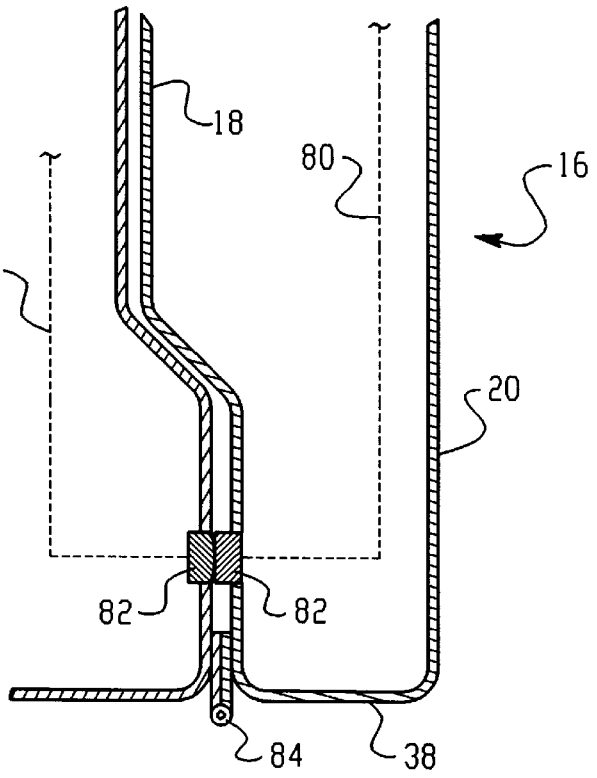
FIGS. 6A and 6B are schematic, cross-sectional views of electrical contacts that are used to supply current to lights included as part of the viewing system according to the invention, the contacts in FIG. 6A being closed and the contacts in FIG. 6B being open.
Figure 6B:
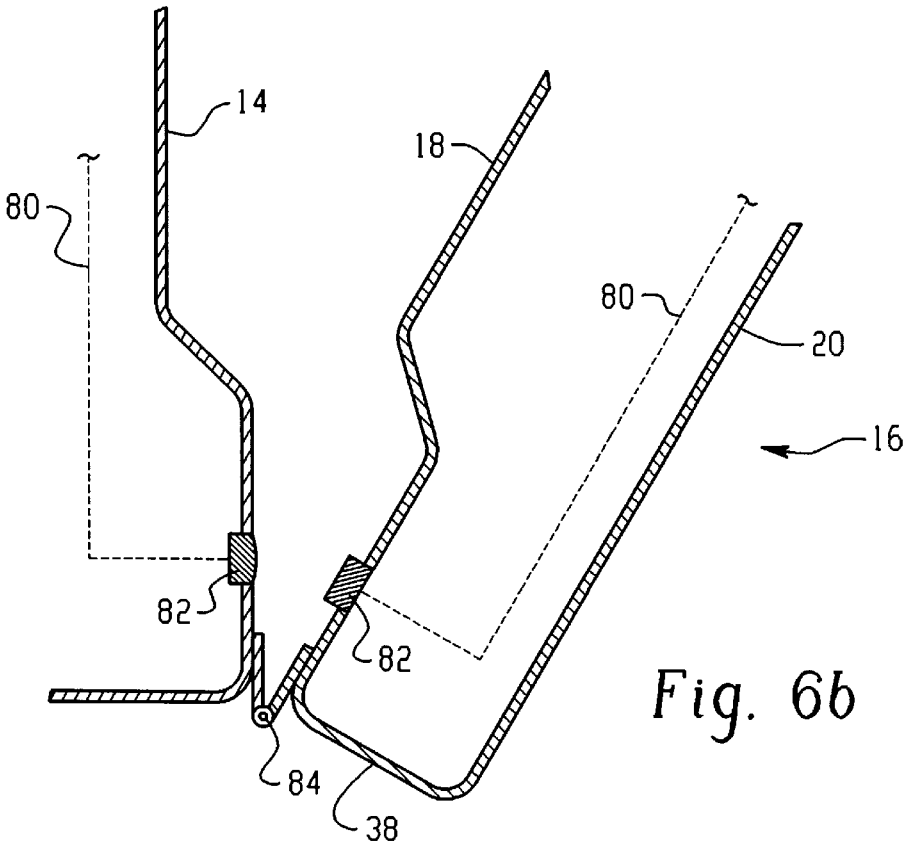

Referring to FIGS. 6A and 6B, a pair of electrical contact 82 are carried by the inner panel 18 and the marginal boundary 14. Upon opening or closing the door 16 by means of a hinge 84, the contacts 82 either will be closed (FIG. 6A) or opened (FIG. 6B). A push button, and preferably, a touch icon capacitance switch (FIG. 1) is included as part of the top cap 24. Upon touching the icon 86, the lamps 78 can be activated whenever desired. However, whenever the door 16 is opened as shown in FIG. 6B, the contacts 82 will be disengaged so as to interrupt current to the lamps 78 regardless of the position of the button 86. The use of make-and-break contacts is preferable to hard wiring which can fail prematurely. Preferably, lamps 78 comprise 12 volt, 20 amp halogen bulbs.

Figure 4:
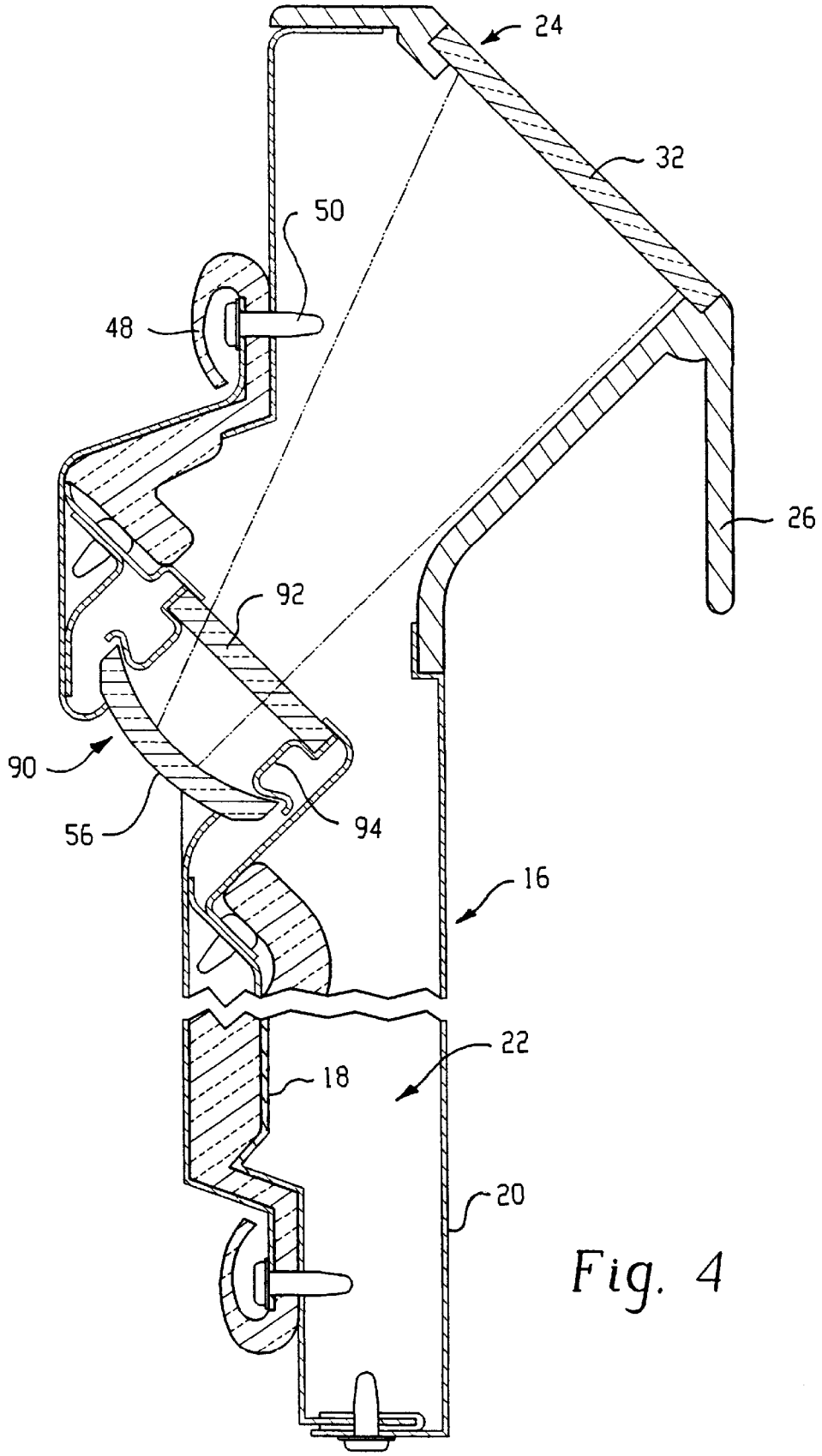
FIG. 4 is a cross-sectional view of an alternative embodiment of the invention, showing another type of viewing system.

A first alternative embodiment of the invention is shown in FIG. 4 and is indicated generally by the reference numeral 90. The embodiment 90 is a variation of the viewing system 52. Because the invention shown in FIG. 4 is similar to the previously described embodiment, like reference numerals will be used for common components where appropriate.

The embodiment 90 includes a convex lens 92 that is disposed adjacent the lens 56. The lens 92 is spaced from the lens 56 by means of a lens holder/spacer 94. In the embodiment 90, the lens 92 constitutes the first light transmissive device. There is no need for a second light transmissive device in the embodiment 90 because, as shown in FIG. 4, light from the lens 92 is focused directly on the window 32. In order to facilitate convenient viewing by the user, the lens 56 and the lens 92 are inclined upwardly at approximately a 45 degree angle to the horizontal. The window 32 also is inclined at an angle of approximately 45 degrees to the horizontal.

Figure 5:
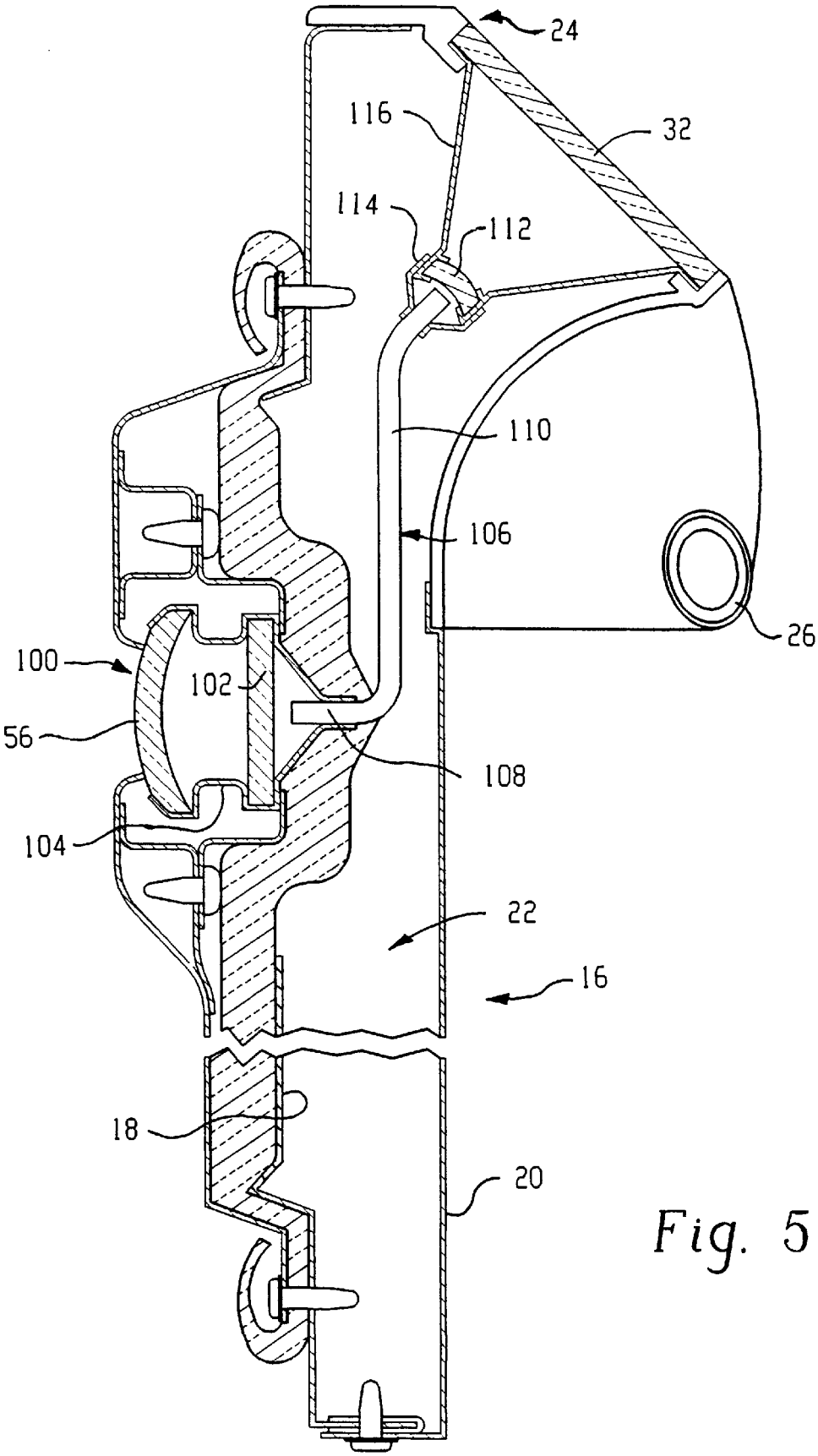
FIG. 5 is a cross-sectional view similar to FIG. 4 showing yet another type of viewing system included as part of the invention.

Referring now to FIG. 5, a second alternative embodiment of the invention is indicated generally by the reference numeral 100. In this embodiment of the invention, a concave lens 102 is disposed adjacent the lens 56. The lens 102 is held in place by a lens holder/spacer 104. In the embodiment 100, a second light transmissive device includes a light pipe 106. The light pipe 106 has a first end 108 disposed adjacent the concave lens 102 and a second end 110 that is remote from the lens 102. A wide-angle lens 112 is disposed adjacent the second end 110. A pair of brackets 114, 116 hold the lens 112 and the second end 110 close to each other. As will be apparent from an examination of FIG. 5, light passing through the lens 56 and the lens 102 will be transmitted by the light pipe 106. Upon passing through the lens 112, the light will be projected onto the window 32. As in the first alternative embodiment 90, the window 32 in the second alternative embodiment 100 is inclined at an angle of approximately 45 degrees to the horizontal.

Figure 7:
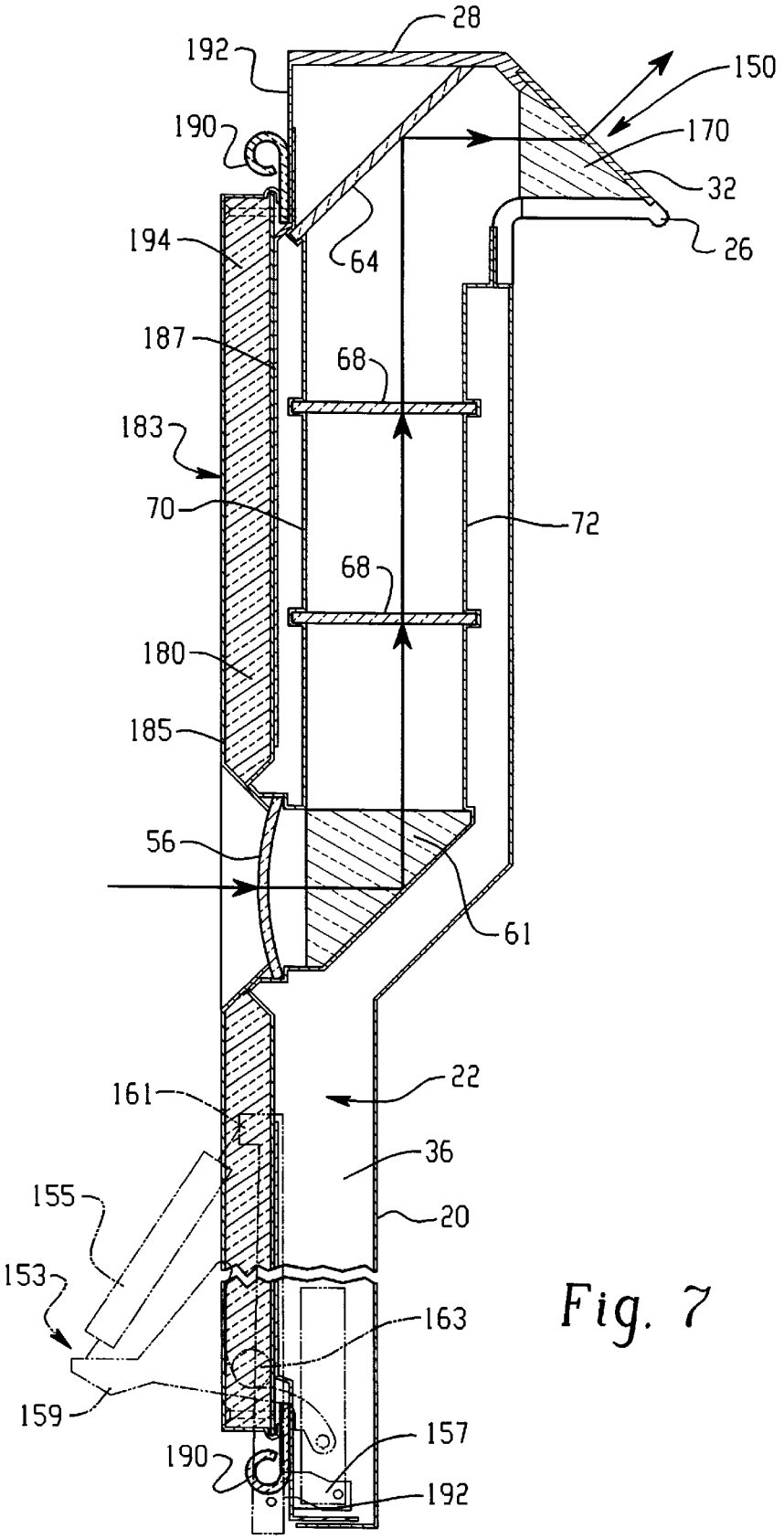
FIG. 7 is a cross-sectional view similar to FIG. 4 of yet another oven door made in accordance with the present invention.

Referring now to FIG. 7 a third alternative embodiment of the invention is shown and is generally indicated by reference numeral 150. Embodiment 150 is a variation of the embodiment of FIG. 3 and thus like reference numerals have been used for common components when appropriate. Along with embodiment 150 there is schematically shown a conventional spring-loaded hinge system 153 having a spring 155, a lower hinged bracket 157, an upper hinged bracket 159, a spring support arm 161 and a stationary roller 163. This type of hinge system may be found in numerous conventional household cooking ranges. Of course, it will be appreciated that the principles of the present invention are applicable to a door with various hinge configurations, and the invention is not limited to the hinges shown herein.

Embodiment 150 includes a viewing window 32 disposed on about a 45° angle. A second prism 170 facilitates directing the light at an appropriate 45° angle through window 32 as shown. Embodiment 150 also includes a molded metal oxide thermal insulation 180 that is molded into a porcelainized steel retainer assembly 183. Assembly 183 comprises a plate 185 and an inner plate 187, the refractory being molded or cast between the plates 185 and 187. An example of a suitable insulation material that could be utilized is a castable grade of the MICROTHERM insulation. A separate conventional fiberglass gasket 190 is compressed along the outer periphery of inner plate 187 against the inner panel 192 of the door using fasteners 194. Gasket 190 provides a thermal seal against the oven boundary when the door is closed.

It will be appreciated that although in the attached drawings the viewing systems appear fairly large (wide), in reality such systems will be considerably thinner, such systems being enlarged in order to facilitate a clear illustration of the viewing system and related parts.

It will be appreciated from the foregoing description that the invention provides a highly effective technique for viewing the interior of the oven. The viewing system enables the user to view the interior of the oven without bending over or opening the oven door. The viewing system can be implemented easily without requiring any modification of existing ranges except to add suitable electrical contacts for the electric lights carried by the door. The oven door is well insulated in an inexpensive, effective manner. The viewing system is more energy efficient than conventional door-mounted windows. Moreover, the door-carried lighting system illuminates the interior of the oven better than conventional oven lighting techniques, in part because glare is reduced and illumination is more even.

Although the invention has been disclosed in its preferred embodiment with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever degree of patentable novelty exists in the invention disclosed.

What is claimed is:

1. An oven for a cooking range, the oven having a cavity, a marginal edge defining the boundary of the cavity, and a door, the door including an inner panel that faces the cavity and an outer panel generally parallel with and spaced from the inner panel, the inner and outer panels being connected adjacent their upper edges by an upper panel, the door comprising:

an opening in the inner panel;

a first window mounted in the opening in the inner panel;

a first light transmissive device disposed between the inner and outer panels, the first light transmissive device directing light received through the first window toward the upper panel;

an opening in the upper panel; and a second window mounted in the opening in the upper panel through which light from the first light transmissive device can pass.

2. The oven claim 1, wherein the first window is in the form of a wide-angle lens.

3. The oven of claim 1, wherein the first light transmissive device is a first prism.

4. The oven of claim 1, wherein the first prism is a right-angled prism, the smaller faces of which are oriented perpendicular and parallel, respectively, to the path of light that passes through the first window.

5. The oven of claim 1, further comprising a second light transmissive device disposed between the inner and outer panels adjacent the second window, the second light transmissive device receiving light from the first light transmissive device and directing it first horizontally and then vertically.

6. The oven of claim 5, wherein the second light transmissive device includes a mirror inclined at an angle of 45 degrees to the path of the light received from the first light transmissive device and a second, right-angled prism whose smaller faces are disposed perpendicular and parallel, respectively, to the path of the light reflected from the mirror.

7. The oven of claim 2, wherein the first light transmissive device is a convex lens that is disposed adjacent the wide-angle lens, the light from the convex lens being directed against the second window.

8. The oven of claim 2, wherein the first light transmissive device is a concave lens that is disposed adjacent the wide-angle lens, and further comprising:

a second light transmissive device disposed between the inner and outer panels and between the concave lens and the second window, the second light transmissive device receiving light from the concave lens and directing it against the second window.

9. The oven of claim 8, wherein the second light transmissive device includes a convex lens and a light pipe having first and second opposed ends, the first end of the light pipe being disposed adjacent the concave lens and the second end of the light pipe being disposed adjacent the convex lens, the convex lens receiving light from the light pipe and directing it onto the second window.

10. The oven of claim 5, further comprising a transparent heat shield disposed between the first and second panels and intermediate the first light transmissive device and the second window, the second light transmissive device comprising a mirror inclined at an angle of about 45 degrees to the path of the light received from the first light transmissive device and a second, right angled prism whose smaller faces are disposed perpendicular and parallel, respectively, to the path of the light reflected from the mirror.

11. The oven of claim 10, wherein two transparent heat shields are provided, the heat shields being spaced from each other and disposed at right angles to the path of the light transmitted by the first light transmissive device.

12. The oven of claim 1, further comprising a first light secured to the inner panel and disposed so as to illuminate the interior of the oven when the door is closed.

13. The oven of claim 12, wherein the first light is a low voltage halogen lamp.

14. The oven of claim 12, further comprising electrical contacts carried by the inner panel and the marginal edge of the oven, the contacts engaging each other when the door is closed in order to conduct electrical current to the first light.

15. The oven of claim 12, further comprising a second light secured to the inner panel and disposed so as to illuminate the interior of the oven when the door is closed, the first window being disposed at approximately the center of the inner panel, and the first and second lights being disposed on either side of the first window in approximate alignment with the first window.

16. The oven of claim 1, further comprising:

a plate disposed between the inner panel and the interior of the oven; and a layer of insulation disposed between the inner panel and the plate, the plate being connected to the inner panel such that the insulation is held in place between the plate and the inner panel.

17. The oven of claim 16, wherein the edges of the plate are spaced inwardly from the edges of the inner panel, and further comprising a thermal gasket disposed about the periphery of the layer of insulation, the gasket extending beyond the edges of the plate, the gasket engaging the marginal edge of the oven when the door is closed, the gasket being compressed against the marginal edge of the oven by the inner panel.

18. The oven of claim 16, wherein the layer of insulation comprises a metal oxide microporous insulation having a thermal conductivity less than about 0.029 w/(m.k) at 0° C.

19. A door for the oven of a cooking range, the oven having a cavity and a marginal edge defining the boundary of the cavity, the door having an inner panel that in use closes the oven cavity and an outer panel spaced from the inner panel, the inner and outer panels being connected adjacent their upper edges by an upper panel, the door comprising:

an opening in the inner panel at approximately the center of the inner panel;

a first window in the form of a wide-angle lens mounted in the opening in the inner panel;

a first light transmissive device disposed between the inner and outer panels, the first light transmissive device being in the form of a first, right-angled prism whose smaller faces are oriented perpendicular and parallel, respectively, to the path of the light received through the first window;

an opening in the upper panel;

a second window mounted in the opening in the upper panel; and a second light transmissive device disposed between the inner and outer panels adjacent the second window, the second light transmissive device including a mirror inclined at an angle of 45 degrees to the path of the light received from the first prism and a second prism disposed in the path of the light reflected from the mirror.

20. The oven of claim 19, further comprising at least two transparent heat shields disposed between the first and second panels and intermediate the first prism and the mirror, the heat shields being spaced from each other and oriented at right angles to the path of the light reflected from the first prism.

21. A door for the oven of a cooking range, the oven having a cavity and a marginal edge defining the boundary of the cavity, the door having an inner panel that in use closes the oven cavity and an outer panel spaced from the inner panel, the inner and outer panels being connected adjacent their upper edges by an upper panel, the door comprising:

an opening in the inner panel at approximately the center of the inner panel;

a first window in the form of a wide-angle lens mounted in the opening in the inner panel;

a first light transmissive device disposed between the inner and outer panels, the first light transmissive device being in the form of a right-angled prism whose smaller faces are oriented perpendicular and parallel, respectively, to the path of the light received through the first window;

an opening in the upper panel;

a second window mounted in the opening in the upper panel;

a second light transmissive device disposed between the inner and outer panels adjacent the second window, the second light transmissive device including a mirror inclined at an angle of 45 degrees to the path of the light received from the first prism and a second, right-angled prism whose smaller faces are disposed perpendicular and parallel, respectively, to the path of the light reflected from the mirror;

at least two transparent heat shields disposed between the inner and outer panels and intermediate the first prism and the mirror, the heat shields being spaced from each other and oriented at right angles to the path of the light reflected from the first prism; and first and second low voltage halogen lamps secured to the inner panel and positioned so as to illuminate the interior of the oven when the door is closed;

the first window being disposed in the approximate center of the inner panel and the first and second lights being disposed on either side of the first window in approximate alignment therewith;

electrical contacts carried by the inner panel and the marginal edge of the oven, the contacts engaging each other when the door is closed in order to conduct electrical current to the first and second lights;

a plate disposed between the inner panel and the interior of the oven;

a layer of microporous insulation disposed between the inner panel and the plate, the plate being connected to the inner panel such that the insulation is compressed between the plate and the inner panel;

the edges of the plate being spaced inwardly from the edges of the inner panel; and a thermal gasket disposed about the periphery of the layer of insulation, the gasket extending beyond the edges of the plate, the gasket engaging the marginal edge of the oven when the door is closed, the gasket being compressed against the marginal edge of the oven by the inner panel.

* * * * *